US006021627A

United States Patent [19]

Mossbeck et al.

[11] Patent Number: 6,021,627

[45] Date of Patent: Feb. 8, 2000

[54] MANUFACTURE OF POCKETED COMPOUND NESTED COIL SPRINGS

[75] Inventors: Niels S. Mossbeck, Dayton, Tenn.; Thomas J. Wells, Carthage, Mich.; Simon Paul Spinks, North Yorkshire, United Kingdom

[73] Assignee: L & P Property Management Company, South Gate, Calif.

[21] Appl. No.: 09/139,166

[22] Filed: Aug. 24, 1998

[51] Int. Cl.[7] ..... B65B 63/02

[52] U.S. Cl. ..... 53/438; 53/50; 53/114; 53/428; 53/529; 29/91.1; 29/896.92

[58] Field of Search ..... 53/50, 114, 428, 53/438, 529; 29/91, 91.1, 896.92; 140/3 CA

[56] References Cited

U.S. PATENT DOCUMENTS

| | | | |
|---|---|---|---|
| 882,654 | 3/1908 | Smith . | |
| 914,312 | 3/1909 | Rutson . | |
| 1,192,510 | 7/1916 | Fischmann . | |
| 1,254,314 | 1/1918 | D'Arcy . | |
| 1,544,237 | 6/1925 | Karr . | |
| 2,241,039 | 5/1941 | Mattison . | |
| 2,567,520 | 9/1951 | McInerney et al. . | |
| 2,663,475 | 12/1953 | McInerney et al. | 53/114 |
| 2,724,842 | 11/1955 | Rogovy . | |
| 2,983,236 | 5/1961 | Thompson | 53/114 X |
| 3,588,993 | 6/1971 | Turner | 53/114 X |
| 3,668,816 | 6/1972 | Thompson | 53/114 X |
| 3,862,751 | 1/1975 | Schwaller . | |
| 4,111,241 | 9/1978 | Crown | 29/896.92 |
| 4,439,977 | 4/1984 | Stumpf . | |
| 4,519,107 | 5/1985 | Dillon et al. . | |
| 4,854,023 | 8/1989 | Stumpf | 53/114 X |
| 5,014,004 | 5/1991 | Kreibich et al. . | |
| 5,303,530 | 4/1994 | Rodgers | 53/114 |
| 5,572,853 | 11/1996 | St. Clair et al. | 53/114 X |
| 5,613,287 | 3/1997 | St. Clair | 53/114 X |
| 5,699,998 | 12/1997 | Zysman . | |
| 5,740,597 | 4/1998 | Eto | 53/114 X |

FOREIGN PATENT DOCUMENTS

| | | |
|---|---|---|
| 3842211 | 6/1990 | Germany . |
| 56123157 | 9/1981 | Japan . |
| 59129021 | 7/1984 | Japan . |
| 20583 | 6/1911 | United Kingdom . |
| 148768 | 7/1920 | United Kingdom . |
| 376291 | 8/1932 | United Kingdom . |
| 618602 | 4/1949 | United Kingdom . |
| PCT 9825503 | 6/1998 | WIPO . |

OTHER PUBLICATIONS

Spuhl, *Automatic Pocket Spring Maching (TF–290)*, Brochure, Mar. 30, 1996.

*Primary Examiner*—Daniel B. Moon
*Attorney, Agent, or Firm*—Wood, Herron & Evans, L.L.P.

[57] ABSTRACT

A system and method for manufacturing pocketed compound nested coil springs includes inserting a compressed, preferably pocketed, smaller coil spring into a horizontally oriented larger coil spring either prior to compressing and inserting the outer coil spring into pocket material or after the larger coil spring has been pocketed thereby requiring the first spring to be inserted into and through an opening in the pocket material.

17 Claims, 3 Drawing Sheets

MANUFACTURE OF POCKETED COMPOUND NESTED COIL SPRINGS

BACKGROUND OF THE INVENTION

The invention relates generally to the construction of spring assemblies or the like. More particularly, it relates to the manufacture of strings of pocketed coil springs for use as the spring cores for mattresses, seat cushions or the like.

Mattress spring core construction over the years has been a continuously improving art with advancements in materials and machine technology. A well known form of spring core construction is known as a Marshall spring construction wherein metal coil springs are encapsulated in individual pockets of fabric and formed as elongate or continuous strings of pocketed coil springs. In an early form, these strings of coil springs were manufactured by folding an elongate piece of fabric in half lengthwise to form two plies of fabric and stitching transverse and longitudinal seams to join the plies of fabric to define pockets within which the springs were enveloped.

Recently, improvements in spring core constructions have involved the use of fabrics which are thermally or ultrasonically weldable to themselves. By using such welding techniques, these fabrics have been advantageously used to create strings of individually pocketed coil springs wherein transverse and longitudinal welds instead of stitching are used to form the pockets encapsulating the springs.

Once strings of pocketed springs are constructed, they may be assembled to form a spring core construction for a mattress, cushion or the like by a variety of methods. For example, multiple or continuous strings may be arranged in a row pattern corresponding to the desired size and shape of a mattress or the like and adjacent rows of strings may be interconnected by a variety of methods. The result is a unitary assembly of pocketed coil springs serving as a complete spring core assembly.

One improvement upon pocketed coil springs as described is a compound nested pocketed coil spring in which each pocket of a string includes two nested coil springs. In such designs, a first inner spring is typically shorter and smaller than a second outer spring. The first inner spring is nested within the second outer spring.

Spring core constructions employing compound nested pocketed springs provide the advantage of offering differing degrees of hardness to the spring unit. Varying degrees of hardness are usually achieved by varying the number of springs per unit area, commonly referred to as the "spring count" of the unit, or by changing the gauge of the wire from which the springs are manufactured. Compound nested pocketed spring coils are disclosed in PCT Application No. PCT/GB97/01759; U.S. Pat. Nos. 1,192,510; 2,567,520; 1,254,314; 882,654; and U.K. Patent No. 20,583. The inner and outer coil springs are nested so that the lower portion of the combined spring unit is reinforced by the inner spring making this portion of the unit much stronger than the upper portion. The upper portion may be flexible enough to provide a resilient and comfortable seating or sleeping surface and the lower portion strong enough to absorb abnormal stresses, weight concentrations or shocks without discomfort or damage.

Commonly, the inner spring of the nested compound spring unit is individually encased in a pocketed fabric material such as shown in U.S. Pat. No. 1,192,510, to minimize noise or interference during the flexing or compression of the compound spring unit.

Another advantage of such compound spring units when employed in a mattress or the like is that the inner spring of each compound nested spring unit is free floating or unsecured. As a result, when the mattress is inverted, the inner spring falls by gravity toward the lower face of the mattress. In this way, regardless of whether the mattress is inhibited or flipped, the inner spring is always at the bottom portion of the spring unit and the compound nested spring units provide a varying degree of flexure from the top to the bottom of the spring unit.

Even though spring units constructed from strings of pocketed compound nested coil springs as described provide many advantages, the manufacture and construction of strings of pocketed compound nested coil springs has proven to be very complicated and often problematic resulting in increased expense for such strings. The construction of strings of pocketed coil springs with a single spring in each pocket is well known in the art and, for example, disclosed in U.S. Pat. No. 4,439,977 which is hereby incorporated by reference in its entirety. The system disclosed in U.S. Pat. No. 4,439,977 includes a spring coiler which forms a coil spring and deposits it about the upper end of an arcuate delivery horn. As such, the formed coil spring is delivered by gravity in a generally vertical orientation for subsequent compression and insertion into the pocketing fabric material.

Another well known system for pocketing coil springs is commercially available from Spühl AG in Switzerland. Examples of such machines include the Spühl TF 90, 190 and 290 series machines. In such machines, a coiler forms a spring and deposits the spring into a trough in a generally horizontal orientation. The spring is then compressed horizontally by a compression paddle, rotated through 90° and then while remaining compressed is inserted between the plies of a folded fabric which is subsequently formed into a pocket around the spring.

One technique for manufacturing pocketed compound nested coil springs which is compatible with the Spühl-type machines is disclosed in UK Patent Application No. 9726333.9 which is hereby incorporated by reference. The system disclosed in that UK patent application calls for the outer coil spring to be pushed over the inner coil spring once it has been dropped into the trough in the generally horizontal orientation. Alternatively, the springs could also be nested by dropping the smaller inner coil spring into the trough in advance of a larger outer coil spring and pushing the inner coil spring into the outer coil spring while both are in generally a horizontal attitude.

While the system disclosed in UK Patent Application No. 9726333.9 provides opportunities to manufacture pocketed compound nested coil springs while utilizing the Spühl-type coiling and pocketing machines, there is a need to provide alternative or additional systems which can be utilized on a production basis and lend themselves to further automation of the procedure so that the manufacture of pocketed compound nested coil springs may be as fully automated as the conventionally preformed production of single pocketed coil springs.

SUMMARY OF THE INVENTION

It has therefore been a primary objective of this invention to provide an improved method and system for the manufacture of strings of pocketed compound nested coil springs.

It has been a further objective of this invention to provide such a method and system which is reliable and cost effective for application in a fully automatic production facility.

It has been a still further objective of this invention to provide such a method and system which is particularly adapted for use with existing production systems for pocketing coil springs, particularly those in which the coil spring is deposited in a generally horizontal attitude prior to being compressed and pocketed.

These and other objectives of the invention have been achieved by a system and method for forming a string of pocketed compound nested coil springs in which a first smaller coil spring is initially formed, preferably pocketed, and compressed. The smaller pocketed coil springs can preferably be produced by known pocketing coil spring machines in which the individual pocketed springs are separated from the string and collected. Larger outer coil springs are also formed and then deposited into a trough or otherwise oriented in a generally horizontal attitude. In a first presently preferred embodiment of this invention, the compressed and pocketed individual smaller coil springs are then inserted between adjacent spaced coils of the larger as yet unpocketed coil spring thereby nesting the first smaller coil spring within the second outer coil spring to form a compound nested coil spring unit. The compound spring unit is then compressed with the longitudinal axis of the inner and outer springs generally horizontal and preferably colinear. The compound nested spring unit is then rotated approximately 90° and then inserted between the plies of a folded fabric for subsequent pocketing as with conventional single spring pocketing machines.

In a second alternative preferred embodiment, the larger coil spring is pocketed in the conventional manner and, after such procedure, the compressed and preferably pocketed smaller coil spring is then inserted into an opening in the fabric surrounding the outer coil spring. The smaller compressed spring is inserted between the adjacent spaced coils of the larger spring in the pocket and then allowed to expand within the larger outer coil spring thereby producing a pocketed compound nested coil spring. The opening in the pocket of the outer coil spring could be provided by a cutter or slitter downstream from the pocketing machinery or two layers of the pocketing material could be merely laid over each other, but not adhered together, at approximately the longitudinal mid point of the coil thereby providing an opening for the insertion of the smaller inner coil spring.

As a result of the present invention, a system and method for manufacturing strings of pocketed compound nested coil springs is provided which is compatible with conventional machinery for pocketing coil springs in a fully automatic production capability.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 2A:
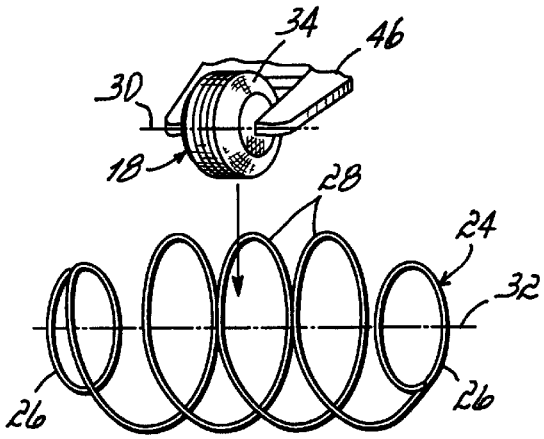
FIG. 2A is a schematic representation of a pocketed and compressed smaller coil spring being deposited between adjacent coils of a larger coil spring according to the first presently preferred embodiment of this invention.
Figure 2B:
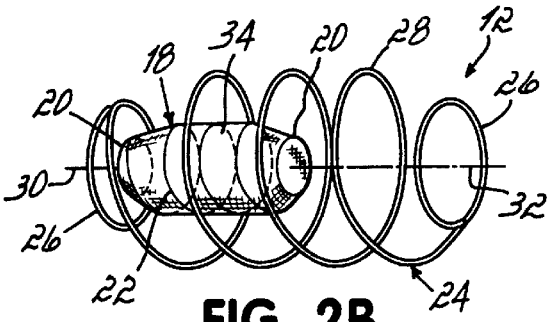
FIG. 2B is a view similar to FIG. 2A after the smaller coil spring has been deposited and nested within the larger coil spring and then allowed to expand.
Figure 3A:
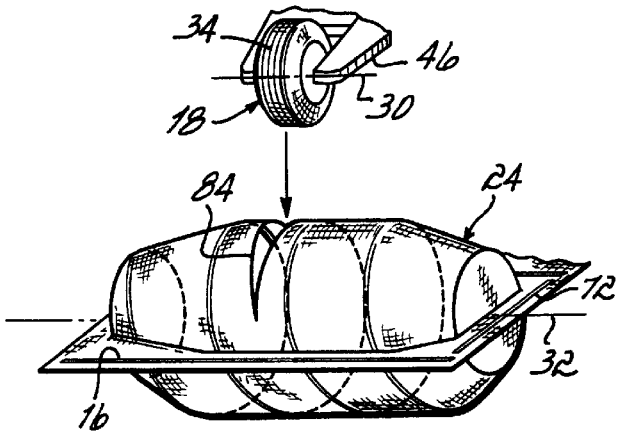
FIG. 3A is a schematic representation of a pocketed and compressed smaller coil spring being deposited in an opening in the fabric encapsulating a larger coil spring according to the second presently preferred embodiment of this invention.
Figure 3B:
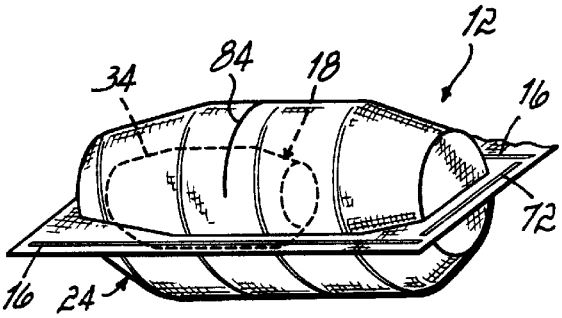
FIG. 3B is a view similar to FIG. 3A after the smaller coil spring has been deposited and nested within the larger coil spring and then allowed to expand.
Figure 2:
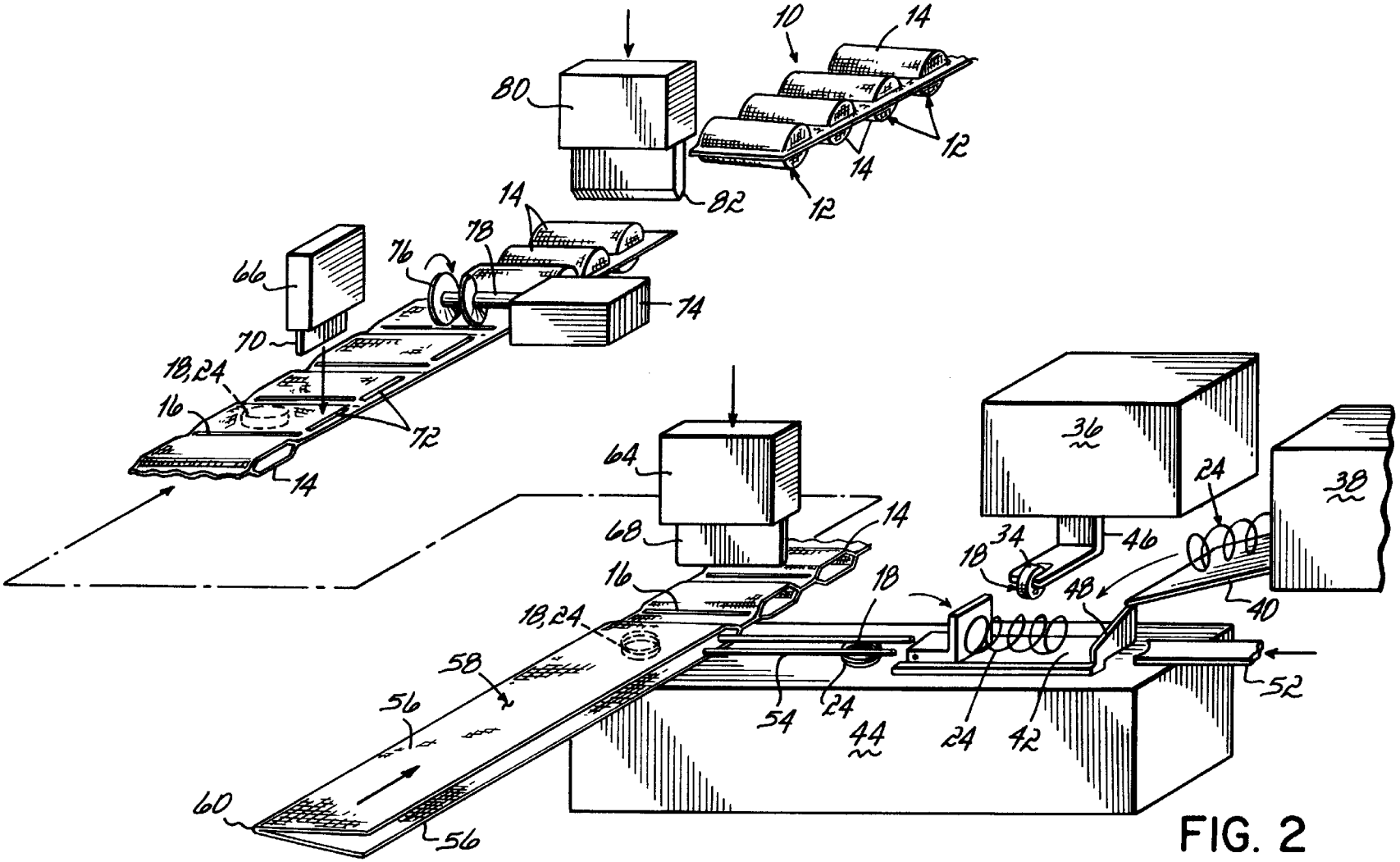
FIG. 2 is a schematic representation of a production system for manufacturing a string of pocketed compound nested coil springs according to a first presently preferred embodiment of this invention.

Referring to FIG. 2, a first presently preferred embodiment of a system and method for manufacturing a string 10 of pocketed compound nested coil springs is shown. The string 10 includes a plurality of compound nested spring units 12 each of which are encapsulated in a fabric pocket 14 and separated from adjacent similar compound nested coil spring units 12 by a seam 16. Each compound nested spring unit 12 includes a first inner smaller coil spring 18 which is typically barrel-shaped in which the terminal coils 20 have a smaller diameter than the intermediate coils 22 (FIG. 2B). The first inner coil spring 18 of the compound nested spring unit 12 is nested within a second outer larger coil spring 24 which is also typically barrel-shaped with the terminal end coils 26 having a smaller diameter than the intermediate coils 28 (FIGS. 2A and 2B). The first and second coil springs 18, 24 each have a plurality of coils which are normally spaced in an uncompressed spring coil configuration. Preferably, the uncompressed height of the first coil spring 18 is less than the uncompressed height of the second coil spring 24; likewise, preferably the diameter of the terminal coils 26 of the second coil spring 24 is greater than an overall diameter of the inner coil spring 18 so that the inner coil spring 18 can be inserted into and entirely contained and retained within the second outer coil spring 24. Each of the coil springs 18, 24 preferably has a longitudinal axis 30, 32 extending along a center line of the coil spring 18, 24 between the terminal coils 20, 26 thereof. Preferably, the first inner coil spring 18 is free floating or unsecured when nested within the second outer coil spring 24 (FIGS. 2B–3B).

Preferably, the first inner coil spring 18 is an individual pocketed coil spring in which the spring is encased within a pocketed fabric 34. The individually pocketed first coil springs 18 may be produced according to any known conventional method and system, such as that shown in U.S. Pat. No. 4,439,977 or according to a Spühl pocketing machine as discussed previously herein.

Furthermore, the system disclosed in FIG. 2 is substantially similar to known pocketing machines for single coil springs with the exception of the modifications to be discussed herein for the production of a string 10 of compound nested pocketed coil springs 12. Specifically, the system shown in FIG. 2 includes a first coiler or coiling station 36 for the production of the first inner coil springs 18. Alternatively, the first coiling station 36 may comprise an entire apparatus for making pocketed coil springs as is well known in the art. The system of FIG. 2 also includes a second coiling station or coiler 38. Each of the coilers 36, 38 are operative to automatically form helical coil springs in synchronized relation with the other operations of the system. The coilers 36, 38 may take any known form for accomplishing the production of coil springs as employed in the strip of pocketed springs.

The second coiler 38 deposits a series of second coil springs 24 from a ramp or transfer station 40 onto a tray or trough 42 supported on a platform 44 with the spring 24 in a generally horizontal attitude.

Figure 1:
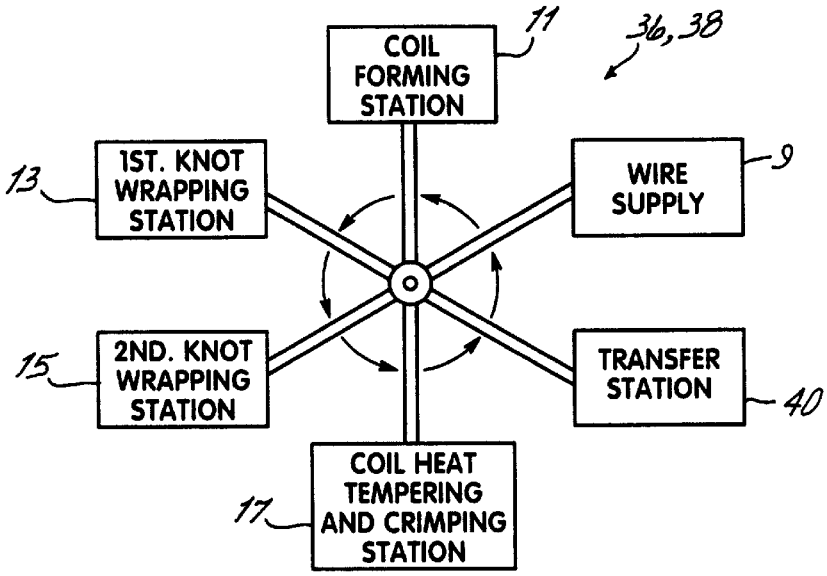
FIG. 1 is a schematic representation of one known system for forming coil springs.

An example of a coiling station 36 or 38 is schematically shown in FIG. 1. The coiler 36, 38 schematically shown in FIG. 1 is disclosed in detail in U.S. pending patent application Ser. No. 08/916,493 filed Aug. 22, 1997, now U.S. Pat. No. 5,934,339 assigned to the assignee of the present invention and hereby incorporated by reference in its entirety. The coiler 36, 38 may include a coil forming station 11 which draws a continuous length of suitable spring wire (not shown) from a conventional wire supply reel 9. The coiler 36, 38 may include a first 13 and/or second 15 wrapping stations for forming a knot at the terminal end of the spring wire which forms the coil spring. Additionally, the spring wire may be tempered, heat treated or otherwise conditioned at a subsequent station 17 and then transferred out of the coiler and down the ramp 40 for subsequent incorporation into a string of pocketed coil springs.

At this position, according to the first presently preferred embodiment of this invention, a bifurcated insertion arm 46 containing a compressed and preferably pocketed individual first coil spring 18 produced by the coiler and/or pocketing system 36 is deposited downwardly between adjacent spaced coils 28 of the second coil spring 24 located in the trough 42, as best shown in FIG. 2. Once the insertion arm 46 positions the first coil spring 18 within the second coil spring 24, the first coil spring 18 is released thereby allowing the spring 18 to expand within its pocket 34 and interiorly of the second coil spring 24 thereby nesting the first and second coil springs 18, 24 to form a compound nested spring unit 12. Preferably, the longitudinal axis 30, 32 of each of the springs 18, 24 are generally parallel if not co-linear and in a generally horizontal attitude.

After the first and second coil springs 18, 24 are nested together on the trough 42, the compound spring unit 12 is compressed by a compression paddle 48 which translates generally horizontally toward a vertically oriented pivot plate 50 to thereby compress the first and second nested coil springs 18, 24.

After the spring unit 12 is compressed, the pivot plate 50 pivots approximately 90° thereby reorienting the springs 18, 24 with their longitudinal axes 30, 32 generally vertical at which time an insertion plunger 52 translates forwardly to push the compressed springs 18, 24 into an insertion track 54 on the platform 44. Continued forward travel of the insertion plunger 52 inserts the compressed nested springs 18, 24 between the plies 56 of an elongate fabric material 58 passing generally perpendicularly past the platform 44. The plies 56 of the fabric 58 are the result of an elongate sheet of fabric 58 being folded about a longitudinal fold line 60. The fabric folder (not shown) may take any of a number of well known forms for folding the sheet of fabric 58 as the fabric 58 is drawn from a roll (not shown) or the like. The remainder of the pocketing apparatus and system for forming the string 10 of pocketed coil springs is conventional and well known as exemplified by the Spühl-type machines previously discussed, with the exception that the spring being pocketed is a compound nested spring unit 12.

The compound nested spring unit 12 is maintained in a compressed configuration with the longitudinal axes 30, 32 of the springs 18, 24 generally vertical and perpendicular to the direction of travel of the fabric 58 and the longitudinal fold line 60 thereof. Individual pockets 14 for the spring units 12 are formed by a first transverse welding station 64 and a second longitudinal welding station 66. The specific embodiment for forming the individual pockets 14 disclosed herein contemplates the use of ultrasonic thermal welding devices for joining the plies 56 of fabric 58 to form the pockets 14 for the springs 18, 24 and, preferably, the utilization of thermally weldable fabric 58 as the pocket material. The present invention, however, should not be regarded as limited to these particular features, inasmuch as other known materials and techniques for joining layers of fabric such as by sewing, the use of mechanical fasteners such a grommets or rivets or clamps or the like may be employed within the scope of this invention. Moreover, alternate systems for pocketing coil springs may also be employed within the scope of the present invention.

The first weld station 64 includes a weld head 68 which projects downwardly to contact the folded fabric 58 between adjacent nested spring units 12 and thereby forming the transverse weld or seam 16 between the adjacent spring units 12. The fabric 58 is then indexed forwardly a plurality of positions, preferably three to four positions, until the second weld station 66 having a weld head 70 forms a longitudinal seam 72 and thereby completes the pocket 14 for the spring unit 12. Downstream from the second weld station 66 is a turning station 74 which, in a particularly preferred embodiment, includes at least one, preferably more, augers 76 mounted on a shaft 78 for rotation to thereby turn the springs 18, 24 within the formed pocket 14 so that the longitudinal axes 30, 32 of the springs 18, 24 are generally horizontal and extending between the fold line 60 and longitudinal seam 72 thereby allowing the springs 18, 24 to expand within the pockets 34, 14. Further downstream from the spring turning station 74 is a cutting station 80 which includes a knife, thermal cutter or similar device 82 for separating a selected number of pocketed spring units 12 to form the string 10 of pocketed compound nested coil springs according to the first presently preferred embodiment of the invention.

Figure 3:
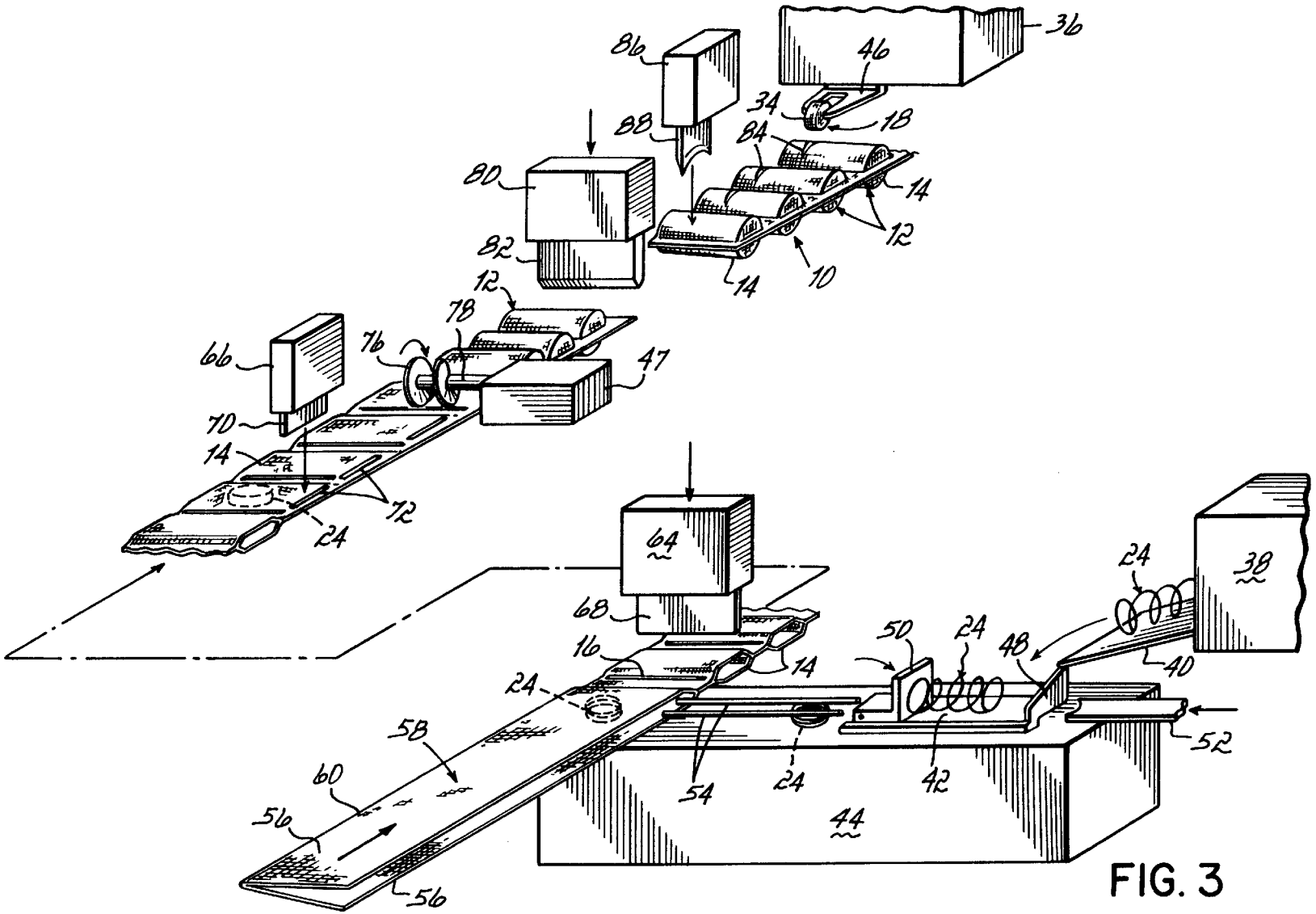
FIG. 3 is a view similar to FIG. 2 of a second presently preferred embodiment of this invention.

Referring to FIG. 3, a second presently preferred embodiment of a system and method for producing the string 10 of pocketed compound nested coil springs is shown. Features and elements of the second presently preferred embodiment of the invention as shown in FIG. 3 which are substantially similar to corresponding elements shown in FIG. 2, are identified by identical reference numerals with respect to those elements in FIG. 2. The second outer coil spring 24, according to the embodiment of the invention shown in FIG. 3, is manufactured and pocketed according to known techniques, for example, the Spühl systems previously identified for encasing individual spring coils in pocketed fabric material. Particularly, the second outer coil 24 is formed in the second coiler 38, deposited into the trough 42 in a horizontal attitude for compression and insertion between the plies 56 of the elongate fabric 58 sheet. The individual pockets 14 are formed by the spaced welding stations 64, 66 comprising the transverse weld head 68 upstream approximately three to four stations from the downstream longitudinal weld head 70. The individual springs 24 are subsequently turned within the pocket 14 at the turning station 74 so that the longitudinal axis 32 of the spring 24 extends between the longitudinal fold line 60 and the longitudinal weld 72 of the individual pockets 14.

After the individual second coil springs 24 are turned within the fabric pockets 14, the first coil springs 18 which are preferably individually pocketed and compressed are inserted through an opening 84 in the pocket 14 of second coil springs 24. Particularly, one option is for a slitting station 86 having a cutting or slitting blade 88 or the like which engages a sidewall of the pocket 14 to cut or slit the opening 84 therein between adjacent spaced coils 28 of the second coil spring 24 to form the opening 84. Subsequently, the bifurcated insertion arm 46 containing an individual, preferably pocketed, first coil spring 18 inserts the first spring 18 downwardly through the opening 84 in the pocket 14 and between spaced adjacent coils 28 of the second coil spring 24. Upon releasing the first coil spring 18, the insertion arm 46 is retracted and the first coil spring 18 is allowed to expand interiorly of the second coil spring 24 and the pocket material 14 thereby providing a pocketed compound nested coil spring unit 12.

According to FIG. 3, the cutting station 80 is upstream from the slitting station 86 and insertion position for the first coil spring 18; however, the cutting station 80 which separates the strings 10 of pocketed coil springs may be located downstream from the slitting station 86 and first coiler 36.

As an alternative to forming the opening 84 with the slitter or cutting station 86, encasing the second coil spring 24 in an envelope or pocket 14 that includes an open flap proximate the mid point of the spring 24 would provide the opening 84 for the insertion of the first coil spring 18. In other words, the two plies 56 of fabric 58 will merely be laid over one another at a particular point and not welded or secured together at a point corresponding to a gap between adjacent coils 28 in the second coil spring 24. Such an opening 84 would alleviate the need for the slitting station 86 while still providing an opening 84 for the insertion of the first coil spring 18.

From the above disclosure of the general principles of the present invention and the preceding detailed description of a preferred embodiment, those skilled in the art will readily comprehend the various modifications to which this invention is susceptible. Therefore, we desire to be limited only by the scope of the following claims and equivalents thereof.

We claim:

1. A method of forming a string of pocketed compound nested coil springs, the method comprising the steps of:

forming a plurality of individual first coil springs each of a first uncompressed height and having a longitudinal axis;

orienting each of the first coil springs with its longitudinal axis in a generally horizontal attitude;

compressing each of the first coil springs;

forming a plurality of individual second coil springs each of a second uncompressed height which is greater than the first uncompressed height of the first coil springs, each of the second coil springs having a longitudinal axis and a plurality of normally spaced coils;

orienting each of the second coil springs with its longitudinal axis in a generally horizontal attitude;

inserting each of the compressed first coil springs between adjacent spaced coils of one of the second coil springs and thereby nesting each of the first coil springs within one of the second coil springs;

compressing each of the second coil springs;

orienting each of the compressed second coil springs with its longitudinal axis in a generally vertical attitude;

folding an elongate sheet of fabric about a longitudinal fold line into two plies of fabric joined by the longitudinal fold line;

inserting each of the compressed second coil springs between the plies of the folded fabric; and forming an individual pocket in the fabric around each of the second coil springs.

2. The method of claim 1 further comprising:

forming an individual fabric pocket around each of the first coil springs prior to inserting it into one of the second coil springs.

3. The method of claim 1 wherein the inserting of the first coil spring into the associated second coil spring occurs after the second coil spring is oriented with its longitudinal axis generally horizontal and prior to the compressing of the second coil spring.

4. The method of claim 1 wherein the inserting of the first coil spring into the associated second coil spring occurs after the forming of the pocket around the second coil spring, the method further comprising:

inserting the first coil spring into an opening in the fabric of the pocket around the second coil spring.

5. The method of claim 4 further comprising:

cutting the fabric of the pocket around the second coil spring to form the opening prior to the inserting of the first coil spring into the second coil spring.

6. The method of claim 1 wherein the first coil spring is not secured to the second coil spring after the inserting.

7. The method of claim 1 wherein the forming of the fabric into the pocket is accomplished by at least one of the steps of welding, stitching, and mechanical fastening of the fabric.

8. The method of claim 1 further comprising:

turning each of the second springs within the associated formed pocket so that the longitudinal axis of the second spring is generally perpendicular to the longitudinal fold line of the fabric.

9. The method of claim 1 further comprising:

expanding the compound nested first and second coil springs within the pocket.

10. The method of claim 1 wherein the first coil spring is inserted into the associated second coil spring generally perpendicularly to the longitudinal axis of the second coil spring.

11. A method of forming a string of pocketed compound nested coil springs, the method comprising the steps of:

forming a plurality of individual first coil springs each of a first uncompressed height and having a longitudinal axis;

forming an individual fabric pocket around each of the first coil springs;

compressing each of the pocketed first coil springs;

forming a plurality of individual second coil springs each of a second uncompressed height which is greater than the first uncompressed height of the first coil springs, each of the second coil springs having a longitudinal axis and a plurality of normally spaced coils;

orienting each of the second coil springs with its longitudinal axis in a generally horizontal attitude;

inserting each of the compressed and pocketed first coil springs between adjacent spaced coils of one of the second coil springs and thereby nesting each of the first coil springs within one of the second coil springs to produce a compound nested spring unit;

compressing each of the compound nested spring units;

orienting each of the compound nested spring units with its longitudinal axis in a generally vertical attitude;

folding an elongate sheet of fabric about a longitudinal fold line into two plies of fabric joined by the longitudinal fold line;

inserting each of the compound nested spring units between the plies of the folded fabric; and forming an individual pocket in the fabric around each of compound nested spring units.

12. The method of claim 11 wherein the first coil spring is not secured to the second coil spring in each of the compound nested spring units.

13. The method of claim 11 wherein the forming of the fabric into the pocket is accomplished by at least one of the steps of welding, stitching, and mechanical fastening of the fabric.

14. The method of claim 11 further comprising:

turning each of the compound nested spring units within the associated formed pocket so that its longitudinal axis is generally perpendicular to the longitudinal fold line of the fabric.

15. The method of claim 11 wherein the first coil spring is inserted into the associated second coil spring in a direction generally perpendicularly to the longitudinal axis of the second coil spring.

16. A method of forming a string of pocketed compound nested coil springs, the method comprising the steps of:

forming a plurality of individual first coil springs each of a first uncompressed height and having a longitudinal axis;

forming an individual fabric pocket around each of the first coil springs;

compressing each of the pocketed first coil springs;

forming a plurality of individual second coil springs each of a second uncompressed height which is greater than the first uncompressed height of the first coil springs, each of the second coil springs having a longitudinal axis and a plurality of normally spaced coils;

orienting each of the second coil springs with its longitudinal axis in a generally horizontal attitude;

compressing each of the second coil springs;

orienting each of the compressed second coil springs with its longitudinal axis in a generally vertical attitude;

folding an elongate sheet of fabric about a longitudinal fold line into two plies of fabric joined by the longitudinal fold line;

inserting each of the compressed second coil springs between the plies of the folded fabric;

forming an individual pocket in the fabric around each of the compressed second coil springs;

expanding each of the second coil springs;

inserting one of the compressed and pocketed first coil springs into an opening in the fabric of the pocket around each of the second coil springs, the compressed and pocketed first coil springs being inserted between adjacent spaced coils of one of the second coil springs and thereby nesting one of the first coil springs within each of the second coil springs.

17. The method of claim 16 further comprising:

cutting the fabric of the pocket around the second coil spring to form the opening prior to the inserting of one of the compressed and pocketed first coil springs into the associated second coil spring.

* * * * *